United States Patent [19]

Chamberlin et al.

[11] 4,437,481

[45] Mar. 20, 1984

[54] SELF-ACTUATING DRIP VALVE

[76] Inventors: John M. Chamberlin, 2800 Dunsinane Rd., Pensacola, Fla. 32503; John R. Chamberlin, 1767 Ensenada Dos, Pensacola Beach, Fla. 32561

[21] Appl. No.: 380,315

[22] Filed: May 20, 1982

[51] Int. Cl.[3] ..... E03B 7/12

[52] U.S. Cl. ..... 137/60; 137/62; 137/79; 237/80; 251/368

[58] Field of Search ..... 137/59, 60, 61, 62, 137/79; 251/368; 237/80

[56] References Cited

U.S. PATENT DOCUMENTS

| | | | |
|---|---|---|---|
| 2,229,529 | 1/1941 | Smith | 137/62 |
| 3,369,556 | 2/1968 | Allderdice | 137/79 |
| 3,380,464 | 4/1968 | Arterbury et al. | 137/60 |
| 3,397,711 | 8/1968 | Strange | 137/62 |
| 3,446,226 | 5/1969 | Canterbury | 137/62 |
| 3,943,969 | 3/1976 | Rubin et al. | 251/368 |
| 4,205,698 | 6/1980 | Hucks | 137/62 |

*Primary Examiner*—George L. Walton

*Attorney, Agent, or Firm*—John E. Benoit

[57] ABSTRACT

A self-actuating drip valve for attachment to a standard faucet for the prevention of freezing of exposed water pipes. An elongated housing includes means for securing one end of the housing about the open end of the faucet. A valve seat is provided within the housing so that it is substantially adjacent to the faucet when the device is in use. Substantially concentric extendible walls extend between the elongated housing and a base plate. A valve stem, terminating in a valve tip, is secured to the base plate and extends within the extendible walls. The base plate may be adjusted by threadable means for moving the valve relative to the valve seat.

26 Claims, 4 Drawing Figures

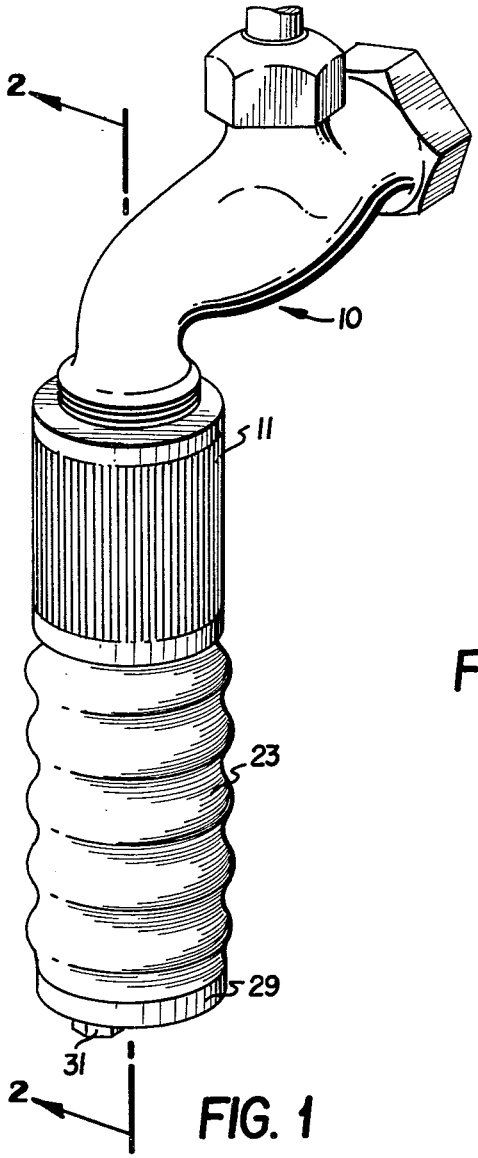
FIG. 1
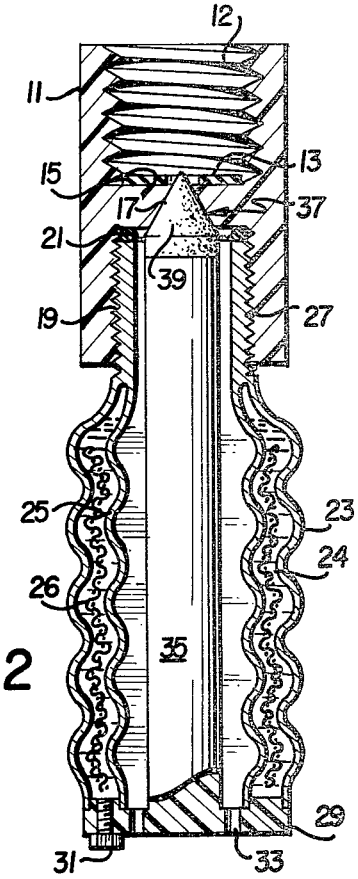
FIG. 2
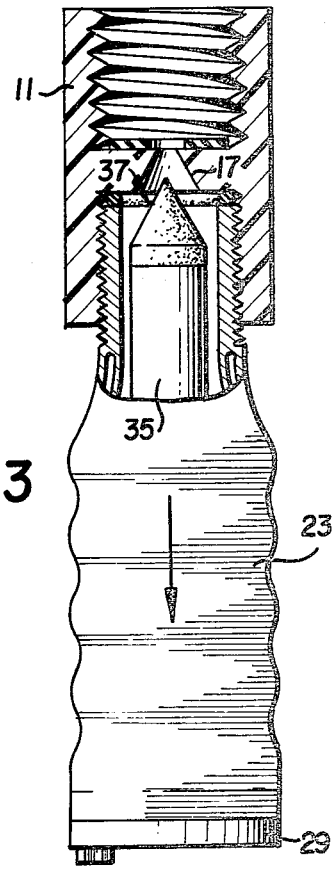
FIG. 3
FIG. 4
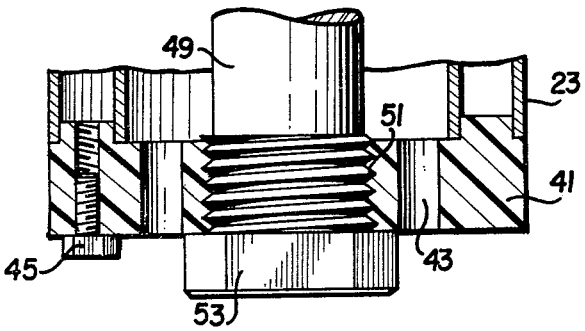

SELF-ACTUATING DRIP VALVE

This invention relates generally to devices for preventing exposed water pipes from freezing and more specifically to a self-actuating drip valve for attachment to a standard outdoor faucet.

BACKGROUND OF THE INVENTION

Freezing of exposed water pipes is well known and is particularly troublesome in those parts of the world where severe freezing is sufficiently infrequent that the housing and plumbing design in construction do not use complete thermal protection of all water pipes since the extra expense is not justified. In such areas, the most common occurrence is the freezing of external water faucets and water pipes to which they are attached, including the extension of the piping into the wall of the house. Rupture during a freeze, followed by melting after the freeze, causes not only damage but, also, a wasteful use of water from the broken valve. Additionally, there is the necessary expense of repair to the valve in the water line associated therewith. A common preventive practice is to manually turn the valves on at least to a bleeding or dripping level prior to the onset of any freezing weather. This works satisfactorily in that the temperature of the household water is sufficient to prevent freezing of the valve and its piping. However, such an operation requires knowledge of an oncoming freezing period and awareness that one must constantly remember to turn the valve. Additionally, if the owners are away from the home when the freezing occurs, this common preventive practice is impossible and the resultant damage occurs.

Numerous devices are known in the prior art. Representative of these various devices are the following patents together with a discussion of the device proposed in the patents.

U.S. Pat. No. 1,134,822 to Lowe illustrates an early system approach to the problem of water pipe freezing wherein a valve is configured to simply respond to a pressure drop resulting from the constriction of water pressure which is created by a self-contained thermal sensing loop within the water pipe as it enters the house.

U.S. Pat. No. 1,200,928 to Egan illustrates an early freeze release valve construction which depends upon an aneroid spring mechanism, and requires manual resetting after a lever has opened the water line to a bleed position.

U.S. Pat. Nos. 1,526,718 and 1,558,276 to Opp and Cartwright respectively, show further water draining devices, and, particularly, integral valving mechanisms. In Opp, the valve member must be opened against the water pressure, so that drained water is insured to freely surround the piston which is then moved by the expansion of the water in a separate chamber. Cartwright shows a container with a valve which will allow release of liquid from the container in response to a freeze. Cooling fluid from the container is allowed to freeze in an exterior region, and then simply lifts up the valve to relieve the pressure. Both Opp and Cartwright are clearly structurally inappropriate for simple mounting upon a male end of a spigot.

U.S. Pat. No. 1,916,038 to Managhan illustrates a valve construction which is dependent upon the fracturing of a glass bottle under freeze conditions. Managhan illustrates a one-shot device wherein replacement of a glass bottle is required each time there has been a freeze.

U.S. Pat. No. 3,320,965 to Morgan illustrates a freeze protection dump valve construction which is configured to respond only to the combined conditions of a lowered line pressure and a subfreezing ambient temperature. Consequently, Morgan significantly requires that the valve close whenever line pressure is greater than, for example, 10 psi, despite any state of contraction for the ambient temperature responsive bellows which he employs.

U.S. Pat. No. 3,369,556 to Allderdice illustrates a freeze device having a single bellows filled with a liquid, such as water. Expansion of the fluid upon a freeze condition will actuate a valve off its seat in a direction against the water pressure within a water line. Importantly, Allderdice requires his device to be mounted vertically and in-line with respect to the household plumbing, with by-pass water passing upwardly, through the device, to an ultimate discharge. It is a permanent part of the household plumbing and not suitable for direct attachment to a water faucet, nor does it operate in conjunction with an existing faucet valve. It stays totally open whenever the ambient temperature is 32° F. or below. Finally, Allderdice's device also requires a lost motion adjustment to ensure actuation, in compensation for its permanency and summer weather.

U.S. Pat. No. 3,380,464 to Arterbury et al is pertinent to an appreciation of the present invention. Arterbury et al illustrates an elongated housing which includes an annular expansion chamber, and, further, a valve member which is hollowed to allow by-pass water to flow through the valve member to an ultimate discharge. Arterbury critically requires that his longitudinally movable valve member be constructed so that the by-pass water will have a heat transfer effect upon the expansion chamber volume. For this purpose, Arterbury requires that a portion of the valve member extend into the household water path in order to ensure that the thermal response of the expansion chamber is dependent upon the temperature of the household water supply. Further, the Arterbury device requires an in-line mounting to the water line.

U.S. Pat. No. 3,397,711 to Strange illustrates a device for releasing water to prevent freezing, wherein contraction of a thermally responsive element opens the drip valve. While Strange illustrates a dump valve mounted upon a downwardly extending spigot, his valving actuator is a series of wafers configured to have a negative coefficient of thermal expansion in the vicinity of 32° F. He critically teaches an external screw adjustment in order to insure valve actuation, and the need for impinging by-pass water directly upon the wafer assembly so as to override a contraction of the wafer due to simple ambient temperatures.

U.S. Pat. No. 3,446,226 to Canterbury is also considered pertinent to an understanding of the present invention, since he teaches an automatic device which is adapted for simple mounting on the male end of a spigot. In Canterbury, the valve actuation is accomplished by a block of material which contracts upon lowered temperatures.

U.S. Pat. No. 3,880,180 to Wismer teaches a water pipe freeze valve which employs a floating piston within an extending housing, whereby expansion of water within the housing raises the piston and snaps open a valve which then opens a separately spaced drain tube. Wismer's construction is, firstly, not adapted to simple mounting on the male end of the spigot and, accordingly, his entire device requires that the piston have a port so that household water from above the piston will be available to fill his expansion fluid volume.

U.S. Pat. No. 4,066,090 to Nakanima et al illustrates a recent patent relating to a water cock having an integrally mounted non-freezing valve. This device operates on the principle of bringing relatively warmer line water up to the valve. This patent also begins with an ambient, local temperature, but then also functions in response to the household water temperature reaching the valve.

U.S. Pat. No. 4,205,698 to Hucks involves the use of a fluid having a negative coefficient of expansion with reduced temperature, with the volumetric change being a gradual change related to temperature rather than being activated at a given, desirable temperature. Also, this valve is dependent upon a spring and several seals. If the seal leaks between the chamber where water exists and the chamber containing the spring, water will flow into the intermediate space, freeze, and make the entire valve inoperable. This valve further requires that bleed water be diverted from the valve in order not to interfere with sensing of true ambient temperature.

An object of the present invention is to provide a device which utilizes the freezing condition as it occurs to self actuate water flow and to prevent line freeze up.

A further object of the invention is to provide a self-actuated water flow valve having substantially few required movable parts and with no necessity of using supplemental springs, packing seals or glands.

Another object of the invention is to provide a self-actuating water valve which requires no need for thermal calibration of mechanical devices.

Yet another object of this invention is to provide a self-actuating water valve which requires no need for resetting the valve after actuation thereof.

A still further object of the invention is to provide a self-actuating drip valve which requires no special activating fluids relative to any sliding surfaces which may be subject to freezing or the like.

Yet a further object of this invention is to provide a device which easily attaches to existing water faucets so that there is no need to permanently install the device in the piping system.

These and other objects of the invention will become apparent from the following description when taken in conjunction with the drawings.

BRIEF DESCRIPTION OF THE DRAWINGS

FIG. 1 is a perspective view of one embodiment of the invention in place on a standard water faucet;

FIG. 2 is a sectional view taken along the lines 2—2 of FIG. 1 with the valve in a closed position;

FIG. 3 is a partial sectional view similar to FIG. 2 with the valve shown in open position; and FIG. 4 is a modification of the base and valve stem used in the present invention.

BRIEF SUMMARY OF THE INVENTION

The present invention provides a self-actuating drip valve for attachment to a standard faucet for the prevention of freezing of exposed water pipes. An elongated housing includes means for securing one end of the housing about the open end of the faucet. A valve seat is provided within the housing so that it is substantially adjacent to the faucet when the device is in use. Substantially concentric extendible walls extend between the elongated housing and a base plate. A valve stem, terminating in a valve tip, is secured to the base plate and extends within the extendible walls. The base plate may be adjusted by threadable means for moving the valve relative to the valve seat.

DETAILED DESCRIPTION OF THE INVENTION

Referring now to FIGS. 1, 2 and 3, there is shown, in FIG. 1, a perspective view of the drip valve of the present invention attached to a standard outdoor faucet 10.

The drip valve includes an elongated housing 11 having a female threaded section 12 which terminates at its lower end at shoulder 15 upon which rests standard washer 13. Valve seat 17 extends below shoulder 15 for purposes which will become obvious as the description proceeds.

A female precision threaded section 19 extends from the lower end of elongated housing 11 upwardly within the housing. An O-ring 21 is shown to provide the necessary sealing.

Spaced, substantially concentric extendible walls 23 and 25 extend between a male precision threaded section 27 which mates with the female threaded section 19. Walls 23 and 25 are secured at their outer end to a base plate 29. As indicated in FIG. 2, the space between the walls 23 and 25 includes a liquid 24 and may also include a nucleating means such as a metal mesh 26. A removable plug 31 is provided in the base plate for providing a means for closing an aperture having access to the interior area between walls 23 and 25 so that the desired fluid may be added as will be discussed below. Ports 33 are provided at the base plug so that water passing through the device may drip outwardly thereof.

In the configuration of FIG. 2, valve stem 35 is integral with the base 29 and extends upwardly terminating in a valve tip 37 which may be covered with sealing material 39 such as rubber or the like.

It is preferable that the walls 23 and 25 have a high thermal conductivity as well as a good modulus of elasticity. Further, it is desirable that these walls have an elastic limit which, when configured into the bellows as shown in FIG. 2, will allow usable spring-like extension in the axial direction. Through the use of materials such as bronze, steel or brass for the walls 23 and 25, the above properties are attained and, additionally, restrict any radial extension to a very minimal amount.

Although not an absolute requirement, it is preferred that the elongated body 11 and the valve shaft 35 be made of a material of relatively poor thermal conductivity such as plastic. Also, the valve shaft may be fluted or have other design features which may be desirable according to usage.

In use, the sealable volume between walls 23 and 25 is filled with a liquid such as water. It is preferred that distilled water be used in order that freezing will take place very close to 32° F. After the interior of the walls is filled, the port is closed with plug 31 and the device is ready to be used. The relatively simple steps of setting the device for actuation consists of screwing the elongated body 11 onto the faucet 10 sufficiently tight so as to assure a good seal at the washer 13. Base 29 is rotated slightly so as to unseat valve tip 37 from valve seat 17 and water faucet 10 is turned on to a flow level somewhat more than enough to achieve normal freeze-preventing bleeding. The water thus released will flow through the valve seat, past the valve stem 35 and outwardly of ports 33. Base 29 is then rotated in an opposite direction so as to move the valve stem to a position wherein valve tip 37 seats against valve seat 17. Under these conditions, the water flow stops and the extendible walls 23 and 25 are then in slight pretension. Thus, the valve is in position and ready to provide its functional purpose as shown in FIG. 2.

When ambient temperature falls to 32° F. and below, the water between the concentric extendible walls 23 and 25 freezes. If distilled water is used, it will freeze at a higher temperature than does normal tap water, since tap water contains a wide variety of soluble ionic materials, all of which lower its freezing temperature somewhat. Additionally, the water between the walls is more exposed than is water in the pipe and in the valve, because of the high thermal conductivity of the walls and also since there is some conduction of house heat along the pipe and the outside faucet towards the drip valve. Insulation might be placed around the exposed pipe and valve 10 to enhance this effect, but should not be placed around the drip valve itself.

As the temperature drops, the water 24 will initially freeze in the sealed volume between the concentric walls 23 and 25. Conducting and/or nucleating means, such as fine metallic mesh 26, might be utilized to additionally aid the freezing of the water. The density of normal ice is 0.917 and the density of cold water is essentially 1.00. As ice forms between the walls, a greater volume, in the ratio of 1.00 divided by 0.917 is required to accommodate it. Since ice has an extremely high compressive strength, and radial extension is limited as discussed above, the elastic axial extension of the walls occurs. This forces base plate 29 away from body 11 as indicated by the arrow, thus unseating the valve stem and causing the water to flow through the drip valve. Extension will be in a relatively true, uncocked manner since ice forming anywhere within the sealed volume results in a uniform, hydraulic increase in internal pressure. The unseating movement of the stem will be proportional to the ratio of the densities to the axial length of the walls and to the percentage of the water turned to ice. For example, with two walls of one inch and one-and-a-half inch nominal diameters respectively, and three inches long, complete freezing will move the valve stem axially 0.27 inches off the valve seat which is an ample amount to release water flow and more than needed for normal bleeding. The valve is now in the position as shown in FIG. 3 and the preset bleed rate of the faucet will then control water flow rates.

During periods of extreme cold, water contained between the walls may well remain frozen, with the valve of the invention open to its maximum. This is a desirable result which allows full bleeding of the preset rate of the faucet. During periods of less intense cold, but still below freezing, the flow of water which is at the household temperature somewhat above freezing may cause the ice within the sealed volume to melt. If so, the valve will close and the water flow will stop. However, with continued cold, the sealed volume will refreeze and the valve will open again prior to water in the pipe or faucet refreezing. This cycling feature minimizes water waste.

FIG. 4 discloses an alternate embodiment wherein a base 41 includes ports 43 and plug 45 for allowing filling of the space between walls 23 and 25. However, in this embodiment, valve shaft 49 terminates at its lower end in a male threaded section which mates with an internally female threaded section of base 41. Means such as hexagonal nut 53 are provided for removing the valve. One advantage of this embodiment is that the valve may be removed, cleaned and/or replaced as is necessary.

It will now be obvious that the present invention provides a significant improvement over the prior art due to its simple construction, and freedom from separate springs, sliding seals and the like. Through the utilization of the laws of nature to compensate directly for ambient freezing conditions using a sealed volume of freezing water, the present invention is simple and requires no constant attention. Also it is very easily used in conjunction with existing faucets.

It is to be understood that the above description and drawings are illustrative only, since various components could be modified without departing from the invention. For example, the housing could be designed so as to be of various geometrical configurations. Further, the overall structure could be configured so that the valve seat is not in the housing, but in a separate, wafer shaped piece between the housing and the bellows. Additionally, the operation of the valve could be modified so as to adjust the original closing of the valve stem of FIG. 4 and not the bellows. Other modifications are also possible without departing from the invention, the scope of which is to be limited only by the following claims.

We claim:

1. A self-actuating drip valve for attachment to a standard faucet to prevent freezing of exposed water pipes comprising:

a housing defining a normally closed chamber removably attachable to said faucet;

valve seat means, said valve seat means being adjacent said faucet and a portion of said housing when said housing is secured to said faucet;

a double-walled bellows fillable with a liquid between said walls having a proximal end attached to said housing and a distal end remote from said housing;

valve means extending substantially coaxially within said bellows in all positions of said valve means and having a proximal end for mating with said valve seat means and a distal end attached to said distal end of said bellows whereby said valve is moved away from said seat when said liquid in said bellows freezes.

2. The drip valve of claim 1 further comprising means for adjusting said valve relative to said seat.

3. The drip valve of claim 2 wherein said adjusting means comprises a female threaded section in the end of said housing adjacent said bellows; and a male threaded section contiguous with said bellows at the proximal end of said bellows for mating with said female threaded section whereby rotation of said bellows moves said valve relative to said valve seat.

4. The drip valve of claim 1 further comprising at least one orifice extending into the space between said double walls of said bellows; and removable plug means in said orifice.

5. The drip valve of claim 1 wherein said bellows is of a material having a high thermal conductivity.

6. The drip valve of claim 1 wherein the material of said bellows is selected from the group consisting of bronze, steel or brass.

7. The drip valve of claim 1 wherein said valve means further comprises seating material between the tip of said valve means which mates with said valve seat.

8. The drip valve of claim 1 wherein said valve means is integral with said bellows.

9. The drip valve of claim 1 wherein said valve means is removably secured to said distal end of said bellows.

10. The drip valve of claim 1 wherein said body and said valve means are of a material of low thermal conductivity.

11. The drip valve of claim 1 wherein said body and said valve means are of a rigid plastic material.

12. The drip valve of claim 1 further comprising nucleating means between said double walls of said bellows.

13. A self-actuating drip valve for attachment to a standard faucet to prevent freezing of exposed water pipes comprising:

a housing;

means for securing one end of said housing about the open end of said faucet;

a valve seat within said housing substantially adjacent said faucet when said open end of said housing is secured to said faucet;

a base plate;

a bellows having spaced, substantially concentric extendable walls coupled between said base plate and said housing for containing fluid therebetween;

valve means for mating with said valve seat extending substantially coaxially within the inner of said extendable walls in all positions of said valve means and being secured to said base plate; and means for adjusting said base plate, said extendable walls and said valve means so as to move said valve means relative to said valve seat.

14. The drip valve of claim 13 wherein said means for securing said one end of said housing about said open end of said faucet comprises a female threaded section at one end of said housing for mating with the standard threaded terminal end of said faucet.

15. The drip valve of claim 13 wherein said adjusting means comprises a female threaded section in the end of said housing adjacent said walls; and a male threaded section contiguous with said walls at the end of said walls opposite said base plate for mating with said female threaded section.

16. The drip valve of claim 13 further comprising at least one orifice extending into the space between said concentric walls; and removable plug means in said orifice.

17. The drip valve of claim 13 wherein said extendable walls are corrugated.

18. The drip valve of claim 13 wherein said extendable walls comprise a bellows.

19. The drip valve of claim 13 wherein said extendable walls are of a material having a high thermal conductivity.

20. The drip valve of claim 13 wherein said walls are selected from the group consisting of bronze, steel or brass.

21. The drip valve of claim 13 wherein said valve means further comprises seating material between the tip of said valve means which mates with said valve seat.

22. The drip valve of claim 13 wherein said valve means is integral with said base plate.

23. The drip valve of claim 13 wherein said valve means is removably secured to said base plate.

24. The drip valve of claim 13 wherein said body and said valve means are of a material of low thermal conductivity.

25. The drip valve of claim 13 wherein said body and said valve means are of a rigid plastic material.

26. The drip valve of claim 13 further comprising nucleating means between said walls.

* * * * *